United States Patent [19]

Weber et al.

[11] Patent Number: 4,893,745

[45] Date of Patent: Jan. 16, 1990

[54] SUSPENDABLE FOLDER

[75] Inventors: Todd A. Weber, Germantown; Albert Narr, Hubertus; Richard A. Lang; James A. Beck, both of Milwaukee; John J. Weber, Jr., Mequon; Gary F. Rasmussen, Wauwatosa, all of Wis.

[73] Assignee: Semco, Inc., Milwaukee, Wis.

[21] Appl. No.: 309,226

[22] Filed: Feb. 13, 1989

[51] Int. Cl.[4] ..... B65D 27/00

[52] U.S. Cl. ..... 229/1.5 R; 229/72; 40/359

[58] Field of Search ..... 229/1.5 R, 72; 40/359

[56] References Cited

U.S. PATENT DOCUMENTS

| | | | |
|---|---|---|---|
| 847,648 | 3/1907 | Carnahan | 229/1.5 R |
| 1,064,000 | 6/1913 | Neff | 229/1.5 R |
| 2,568,941 | 9/1951 | Benson | 229/72 |
| 3,129,872 | 4/1964 | Lutwack | 229/72 |
| 3,863,828 | 3/1975 | King | 229/1.5 R |
| 3,870,223 | 3/1975 | Wyant | 229/1.5 R |
| 3,979,051 | 9/1976 | Close . | |
| 4,192,447 | 3/1980 | Ambrosat et al. | 229/72 |
| 4,301,962 | 11/1981 | Monckton et al. | 229/1.5 R |
| 4,419,837 | 12/1983 | Meeker | 229/1.5 R |
| 4,436,202 | 3/1984 | Berkley | 229/72 |
| 4,576,328 | 3/1986 | Snider et al. | 229/1.5 R |

FOREIGN PATENT DOCUMENTS

| | | | |
|---|---|---|---|
| 2300685 | 3/1975 | France | 229/1.5 R |
| 7810440 | 4/1980 | Netherlands | 229/1.5 R |
| 1223178 | 2/1971 | United Kingdom | 229/1.5 R |

*Primary Examiner*—Stephen Marcus
*Assistant Examiner*—Kathryn M. Stemann
*Attorney, Agent, or Firm*—C. Thomas Sylke; Arnold J. Ericsen

[57] ABSTRACT

A suspendable folder is disclosed having a front panel and a back panel with their bottom edges and a segment of each of their lateral edges secured to one another. A segment of each pair of lateral edges secured to one another is defined by two points, the first of which is near the bottom edge of each panel. The second, upper point is spaced from the first point by a distance preferably selected from the range of approximately one half to two thirds the height of the back panel. At or near the second upper point, a circular radius cut is provided to assist in distributing tearing forces across a large area of both the front panel and back panel. At least one transverse score line is also provided above the radius cut in the front panel to permit easier opening and closing of the folder without tearing.

13 Claims, 1 Drawing Sheet

SUSPENDABLE FOLDER

BACKGROUND OF THE INVENTION

1. Field of the Invention

The present invention relates generally to storage folders. More particularly, the present invention relates to a suspendable folder designed to better resist tearing and increase storage capacity.

2. Description of the Prior Art

Numerous designs for file folders and other storage folders abound in the art. A suspendable folder known in the art is shown in FIGS. 1 through 3. The folder consists generally of a back panel 12, a front panel 14, a suspending rod 15 and a label or tag 22. Generally, folder 10 is made by taking a sheet of material and folding it along a medial line 16, after which flaps 18 and 20 on front panel 14 are folded back around and are cemented to back panel 12. Front panel 14 and flaps 18 and 20 therefore create lateral edges 19 and 21 which further define the pocket of the folder by meeting bottom edge 16 at corners 30. Score lines 24 have been used to permit limited expansion of the folder 10 when materials are placed in it.

In the past, severe ripping and tearing problems have been encountered by users of the folder when attempting to gain access to or briefly scanning the contents of the interior of folder 10. Attempts to cure this problem have focused essentially on increasing the weight or thickness of the material used to make folder 10. While this has ameliorated the tearing problem to a small degree, it has also increased the bulk of the folder 10, making it more difficult to manufacture, package, ship and use. This increased bulk also has led to higher costs in both production and shipping.

Another folder, not of the suspension type, is also shown in U.S. Pat. No. 3,979,051 issued to Close on Sept. 7, 1976 for a "Multi-Compartment Envelope".

A design which would more economically and efficiently accomplish the objects of the art, while significantly reducing tearing, would prove to be a significant advancement in the art.

OBJECTS AND SUMMARY OF THE INVENTION

It is the primary object of the present invention to provide a suspendable folder in which there is maximum resistance to tearing or ripping.

It is another object of the present invention to provide a high-strength folder which can be readily made by hand or on high-speed fabrication machinery.

It is yet another object of the present invention to provide a high-strength suspendable folder which is easily and economically produced, sturdy in construction, and both highly efficient and effective in operation.

Still a different object of the present invention is to provide a high-strength suspendable folder which may be used with existing folder suspension systems and constructions.

One different object of the present invention is to provide a high-strength suspendable folder which is not bulky.

How these and other objects of the present invention are accomplished will be explained in a detailed description of the preferred embodiment of the present invention connection with the FIGURES. Generally, however, the objects are accomplished in a suspendable folder having a front panel and a back panel having their bottom edges and a segment of their lateral edges secured to one another. The segment of each pair of lateral edges secured to one another is defined by two points, the first of which is near the bottom edge of each panel. The second, upper point is spaced from the first point by a distance preferably selected from the range of one half to two thirds the entire height of a given panel. At or near the second upper point, a circular radius cut is provided which assists in distributing, across a large area of both the front panel and back panel, tearing forces encountered when the folder is opened. A transverse score line is also provided above the radius cut in the front panel to permit easier opening and closing of the folder without tearing.

Other ways in which the objects may be accomplished, all of which are deemed to fall within the scope of the present invention, will be described and will become apparent in the remainder of the specification. The descriptions in the specification are deemed to be illustrative and not limiting, the present invention being limited only by the scope of the claims which follow the detailed description of the detailed preferred embodiment.

DESCRIPTION OF THE DRAWINGS

In the FIGURES, like reference numerals refer to like components.

DESCRIPTION OF THE PREFERRED EMBODIMENT

Figures 1, 2, 3, 4, 5, 6, 7:
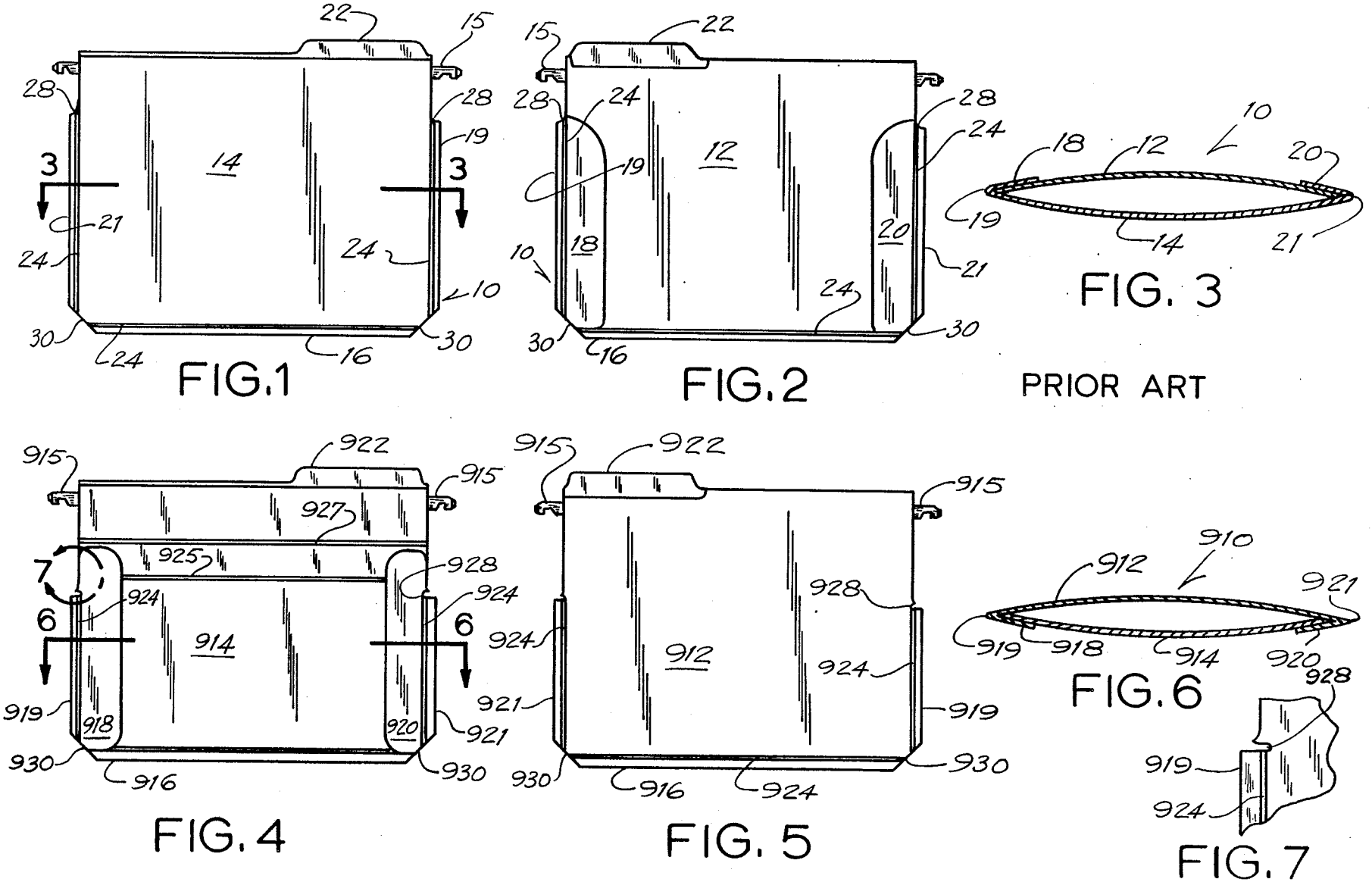
FIG. 3 PRIOR ART
FIG. 1 is a front elevational view of a folder of the prior art.
FIG. 2 is a back elevational view of the folder of FIG. 1.
FIG. 3 is a cross-sectional view of the folder taken along the line 3—3 of FIG. 1.
FIG. 4 is a front elevational view of the folder of the present invention.
FIG. 5 is a back elevational view of the folder of the present invention.
FIG. 6 is cross-sectional view of the folder of the present invention taken along the line 6—6 of FIG. 4.
FIG. 7 is an enlarged view of the section encompassed by circle 7 of FIG. 4.

FIGS. 4 through 7 show the preferred embodiment of the present invention. A folder 910 is made of paper, cardboard, plastic or other suitable material. It includes a back panel 912 with a front panel 914 secured thereto along a transverse line 916. In the preferred embodiment, front panel 914 and back panel 912 are formed from the same sheet of material by making line 916 a transverse fold line. A pair of flaps 918 and 920 project outwardly from the lateral edges of the back panel 912 along fold lines 919 and 921 respectively. Flaps 918 and 920 are secured to front panel 914 by any suitable means, preferably some sort adhesive (not shown). As can be seen in FIGS. 5 and 6, the segments of lateral edges 919 and 921 defining the pocket of the folder 910 are considerably less than that shown in the prior art.

Contrary to traditional thinking and the prior art, use of less adhesive and less paper (or other material) leads to a more durable folder. This is due to more effective dispersal or spreading of tearing forces applied to the folder 910. A number of other features further facilitate opening of the folder as well as inhibiting tearing or ripping when the folder is opened.

At least one score line 925 extends transversely across the front panel 914 to permit easier opening of the folder. A second score line 927 may also be incorporated to further enhance the ease of opening. Any score line 925,927 is located above the topmost point of the pocket defined by lateral edges 919 and 921 and lower edge 916.

As seen in a comparison of FIGS. 3 and 6 positioning of flaps 918 and 920 on the front of folder 910 provides a double thickness of material for front panel 914, the typical site of tearing and ripping in prior art constructions. The present invention therefore realizes double-strength at the points most susceptible to tearing, without the need for increased bulk, thickness or weight of the material used.

Another important feature of the present invention illustrated in FIG. 4 is shown in more detail in FIG. 7. Adjacent the upper end point of each of the lateral edges 919 and 920 is found a circular radius cut 928. The circular shape of radius cut 928 is designed to distribute tearing forces radially outward in front panel 914 and back panel 912. The same thickness paper is therefore able to absorb forces created by opening of the folder considerably more effectively than the standard cut 28 seen in the prior art.

Other features of the present invention folder 910 also aid in reducing tearing. For example, angled corners 930 alleviate stress at the lower corners ad again help to distribute forces applied to the front panel 914 and the back panel 912 more evenly through the paper rather than focusing the forces at a single point. Also, lateral and bottom score lines 924 may be used.

Variations and modifications to the present design will become apparent to one presently of ordinary skill in the art after reading the above specification in connection with the FIGURES. However the scope of the present invention is to be limited only by the scope of the claims which follow.

What is claimed is:

1. A folder having a front panel and a back panel joined at a bottom seam at the bottom of said panels and side seams at the lateral edges of said panels wherein:

(a) each said side seam begins near said bottom seam and extends for a length not greater than approximately two thirds the total length of the lateral edge of said back panel;

(b) said front panel has at least one transverse score line above the upper end of each said side seam; and (c) each said side seam comprises means for distributing tearing forces applied to said side seams.

2. The folder of claim 1 wherein said distributing means comprises a circular radius cut at the upper end of each said side seam.

3. The folder of claim 2 wherein said distributing means further comprises:

(a) flaps hinged to said back panel along axes substantially aligned with the lateral edges of said front panel; and (b) a side seam score line on said back panel extending for substantially the length of each said side seam and adjacent thereto.

4. The folder of claim 3 further comprising bottom score lines adjacent the bottoms of said front and back panels.

5. The folder of claim 4 wherein said folder is suspendable and includes suspension means.

6. The folder of claim 5 wherein the lower corners of said folder are angled and open to facilitate expansion of said folder.

7. A suspendable folder/envelope comprising:

(a) a sheet folded along a medial line thereof defining a front panel and a back panel;

(b) means for securing a segment of each of the lateral edges of said front panel to a corresponding segment of the lateral edges of said back panel;

(c) wherein said segment of each lateral said front panel is defined by a first point and a second, preselected point on each lateral edge of said front panel, each said first point being near said medial line, and each said second point being spaced from said first point by a first distance not greater than approximately two thirds the length of each lateral edge of said front panel;

(d) further wherein said front panel has at least one transverse score line spaced from said medial line by a second distance greater than said first distance;

(e) further wherein said securing means further comprises means for distributing a tearing force near said second point.

8. The folder of claim 7 wherein said distributing means comprises a circular radius cut in each lateral edge of said panels, adjacent said second point.

9. The folder of claim 8 wherein said distributing means further comprises:

(a) flaps hinged to said back panel along axes substantially aligned with the lateral edges of said front panel; and (b) a vertical score line adjacent each lateral edge of said back panel.

10. The folder of claim 9 further comprising:

(a) angle cut and open lower corners; and (b) a bottom score line adjacent the bottom of each said panel.

11. A folder suspendable from a pair of spaced apart supports, said folder including a front panel and a back panel secured to one another at a bottom edge and side edges defining a pocket, wherein:

(a) the length of each said pocket side edge is not greater than approximately two thirds the length of the lateral edge of said back panel; and (b) said folder comprises means for distributing tearing forces applied to said folder comprising a circular radius cut in each said panel adjacent the upper end of each said pocket side edge and at least one transverse score line on said front panel extending substantially between the lateral edges of said front panel and above said pocket side edges.

12. The folder of claim 11 wherein said distributing means further comprises:

(a) flaps hinged to said back panel along axes generally aligned with the lateral edges of said front panel, said flaps being secured to said front panel; and (b) a vertical score line on said back panel adjacent each said pocket side edge.

13. The folder of claim 12 wherein the lower corners of said folder are angled and open to facilitate expansion of said folder, each said panel further comprising a horizontal score line adjacent said bottom edge.

* * * * *